US007631770B2

(12) United States Patent
Martin

(10) Patent No.: US 7,631,770 B2
(45) Date of Patent: Dec. 15, 2009

(54) SPICE AND SMALL ITEM STORAGE SYSTEM

(76) Inventor: Vicki Lee Martin, 2013 S. 350 East, Clearfield, UT (US) 84015

( * ) Notice: Subject to any disclaimer, the term of this patent is extended or adjusted under 35 U.S.C. 154(b) by 0 days.

(21) Appl. No.: 10/956,916

(22) Filed: Oct. 4, 2004

(65) Prior Publication Data

US 2006/0070964 A1 Apr. 6, 2006

(51) Int. Cl.
*A47F 7/00* (2006.01)

(52) U.S. Cl. ..... 211/13.1; 211/113; 211/85.29; 206/806; 248/317

(58) Field of Classification Search ..... 211/13.1, 211/14, 113, 85.29; 224/220, 919; 312/183; 206/583, 315.9, 806; 248/176.1, 214, 317; D7/500; 220/502, 476; 40/642.01, 124
See application file for complete search history.

(56) References Cited

U.S. PATENT DOCUMENTS 2,608,339 A * 8/1952 Benzon-Petersen ..... 206/583
4,125,954 A * 11/1978 Barbieri ..... 40/107
4,327,836 A * 5/1982 Okuno ..... 211/74
4,606,459 A * 8/1986 Luray ..... 206/583
4,717,305 A * 1/1988 Edwards ..... 414/349
4,775,055 A * 10/1988 Morse ..... 211/78
4,802,604 A * 2/1989 Lindsey ..... 220/324
4,832,208 A * 5/1989 Finnegan ..... 211/73
5,083,680 A * 1/1992 Plough ..... 222/142.1
5,211,290 A * 5/1993 Janus et al. ..... 206/583
5,337,907 A * 8/1994 McKenzie et al. ..... 211/88.01
5,368,203 A * 11/1994 Friedrich et al. ..... 222/179.5
5,465,871 A * 11/1995 Robbins, III ..... 222/23
5,513,776 A * 5/1996 Canini ..... 222/149
5,579,917 A * 12/1996 Lofgren et al. ..... 206/583
5,601,213 A * 2/1997 Daniello ..... 222/456
5,762,246 A * 6/1998 Drew ..... 224/312
5,871,107 A * 2/1999 Johnson et al. ..... 211/104
D510,823 S * 10/2005 Ng et al. ..... D6/480

* cited by examiner

*Primary Examiner*—James Kramer
*Assistant Examiner*—Lindsay M. Maguire

(57) ABSTRACT

This spice and small item storage system utilizes generally unused space directly underneath shelving (10) with elastic slings (12) sewn (20) to backing fabric (18), attached by screws through eyelets (14) to a holding surface above. In its preferred embodiment of elastic slings, the system will usually retain the containers even if shook. The system is economical to purchase, simple to install, and easy to take apart. Its small size makes it easy to install incrementally as more sections are needed.

4 Claims, 3 Drawing Sheets

SPICE AND SMALL ITEM STORAGE SYSTEM

BACKGROUND

1. Field of the Invention

Figure 1:
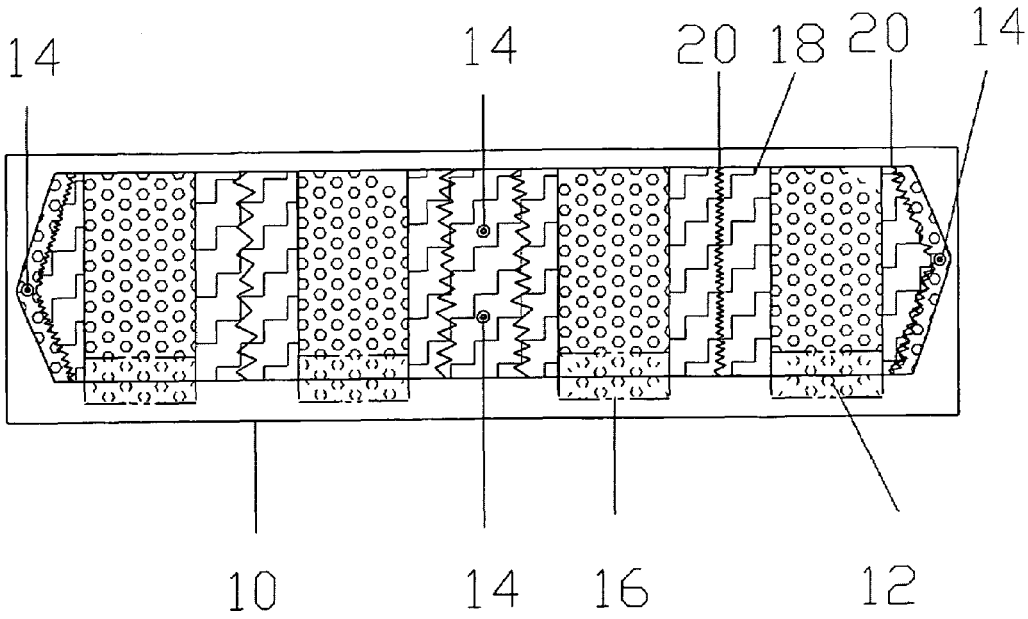

This invention relates to spice and small item storage, mainly spices and herbs, but it is also useful for storing small items in office, bath, craft, electronic, and workshop rooms as well as in motor homes and boats.

2. Description of Prior Art

Spice storage now in use relies mainly on racks. Whether countertop, wall mounted, or hung on the inside of cabinet doors, current small item storage creates a cluttered look and/or takes up valuable space which could be used by other items. Furthermore, this system solves the pressing problem of how to use the space in the undersides of shelves.

Most patents issued are design patents and merely address the look of racks. Some utility spice container designs are Canini (U.S. Pat. No. 5,513,776) which breaks up lumps in the contents. Daniello (U.S. Pat. No. 5,601,213) and Robbins (U.S. Pat. No. 5,465,871) designed pre-measuring caps for spice jars. Among the utility designs for presenting multiple spices are Plough (U.S. Pat. No. 5,083,680) who created a double oval to present two spices and Hofmann (U.S. Pat. No. 4,802,608) whose design also stores multiple ingredients. Other spice designs open the form from a flat rack to other shapes. Morse (U.S. Pat. No. 4,775,055) created a carrousel. Barbieri (U.S. Pat. No. 4,125,954 designed a spice calendar while Finnegan (U.S. Pat. No. 4,832,208) put spice jars on a horizontal incline. Friedrich et al. (U.S. Pat. No. 5,368,203) designed a system requiring the spice containers to be magnetically held. All these designs compete for precious countertop and/or interior cabinet shelf space. Johnson et al. (U.S. Pat No. 5,871,107) patented a hinged sheet metal keeper to be affixed by magnetic tape to the underside of kitchen cabinets. Service (U.S. Pat. No. 4,714,305) designed a pullout spice drawer to fit behind or beside major appliances. Although these do not use countertop space these designs are larger, more costly, more difficult to install and more difficult to remove than the present design.

Other current spice storage available in markets include racks included in cabinet doors taking space from the room rather than the cabinet interior and racks added to the inside of cabinet doors which requires space in the interior of the cabinet when the door is closed. The former solution is built in, costly, and cannot be easily moved if the owner wishes to change; the latter solution has the same problems plus it takes space from the interior that could be used for other items.

Soft hammock and sling designs for shipping boxes may have more connection to the present invention. Janus et al. (U.S. Pat. No. 5,211,290) designed a suspension package as a lidded box with inner slings to cradle the contents during transportation. Lofgren's (U.S. Pat. No. 5,579,917) design included a frame and a hammock. Luray, (U.S. Pat. No. 4,606,459) made a shipping box for fragile articles consisting of a shock absorbing cradle supported only at the ends. B. Benzon-Petersen (U.S. Pat. No. 2,608,339) designed cardboard packing containers cradling fragile items like glass and china in individual Compartments effected by sinuous strips of cardboard within the supporting walls of the box. These containers are uninstalled temporary conveyances to ship delicate possessions. Like other packing containers these sling cardboard boxes would usually be discarded after one use. In contrast the present fabric design is installed inside buildings, motor homes, and boats for permanent, non transportation use. All these designs are movable and include rigid armatures to support the hammocks while slings of the present design hang from attachment above.

Drew (U.S. Pat. No. 5,762,246) invented a compact disc carrier to be attached to the under side of vehicle sun visors. Designed as a flap, Drew's pocket slots accept the 4.5" diameter compact discs which are the depth of a dime. The carrier is frequently moved as the sun visor is used. The carrier can also be independently lifted and lowered to use the vanity mirror located on the sun visor. There are several differences from the present design. Drew's is specifically meant for vehicle sun visors, the present design installs under shelves in buildings as well as in motor homes and boats. Drew's design is frequently moved, the present design is stationary as installed. Drew's pocket design is limited specifically to compact discs 4.5" diameter and the depth of a dime; the present design accepts all items fitting into an approximately 5" long by 1.5" wide bottle.

McKenzie et al (U.S. Pat. No. 5,337,907 designed a non elastic pocket system holding drink cups and personal articles for athletic teams during competitions outdoors. McKenzie et al is designed to be used in a vertical position, such as on a chain link fence, for temporary use such as during games. McKenzie's vertical drink cup holders require bottoms so cans or bottles don't fall through, the present horizontal elastic design slings are open at both ends. The present elastic design installs indoors in a horizontal position under cabinets and shelving for permanent use. An ornamental design from Ng et al. (U.S. Pat. No. US D 510,823S) is a coffee table with adjustable cloth slings to hold magazines and other periodicals. This free standing furniture has rigid end pieces to support the table top and the adjustable slings holding multiple periodicals of various sizes which are located under the tabletop. In contrast to Ng's large furniture design the present small utilitarian design is unobtrusively installed on undersurfaces of shelving and cabinetry with elastic but unadjustable slings.

SUMMARY

The present spice and small item storage system eliminates the problems of previous designs in cluttering counters and wall spaces. The present design uses the unobtrusive and generally unused surface under shelves as the support. The present design is economical to purchase, easy to install and expand, and quick to disassemble when re-locating the system.

OBJECTS AND ADVANTAGES

Therefore, beside the advantages and objects of the spice and small item storage system described in my above patent, several objects and advantages of my present invention are:

(a) to provide quick, though hidden, access to spices and small items which frequently get lost in cupboards and drawers.

(b) to provide safe storage for small items in danger of being broken by being shaken in transit or during an earthquake.

(c) to utilize the usually wasted space directly underneath shelving.

(d) to provide users with an economical storage system easy to knockdown and take to another location.

(e) to provide herbs and spices with a dark, dry storage to prolong freshness.

Further objects and advantages will become apparent from a consideration of the following description and drawings.

DRAWING FIGURES

Figure 2:
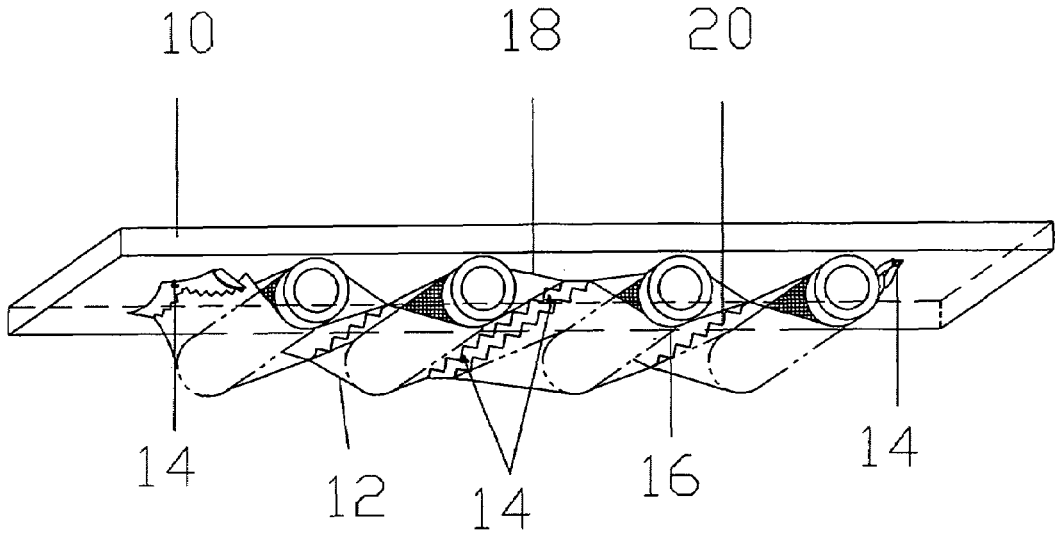
Figure 3:
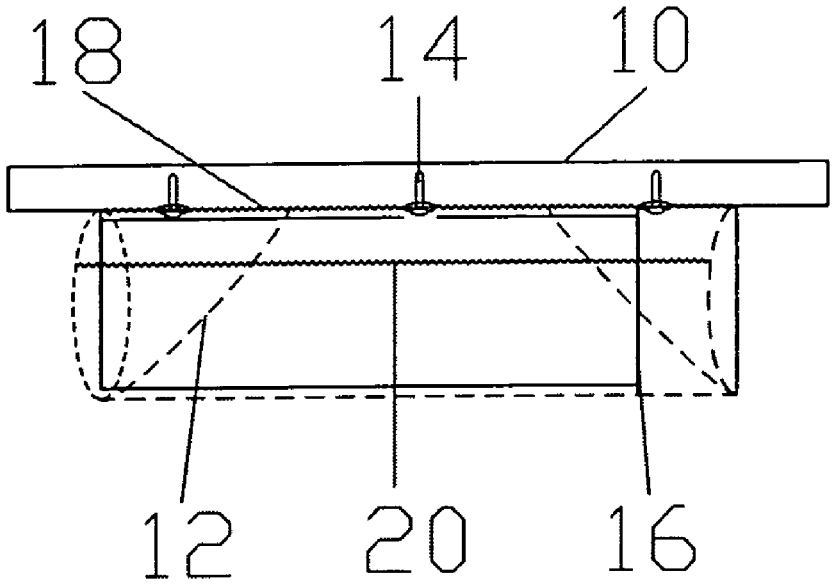

FIG. 1 shows the system from above.
FIG. 2 shows the system from the front.
FIG. 3 shows the system from the side.

REFERENCE NUMERALS TO DRAWINGS

| | |
|---|---|
| 10 | shelf |
| 12 | elastic slings |
| 14 | eyelet and screw attachment |
| 16 | spice bottle in elastic sling |
| 18 | duck cloth backing fabric |
| 20 | stitching |

DESCRIPTION OF THE PREFERRED EMBODIMENT

FIG. 1 shows the entire spice and small item storage system from the top. FIG. 2 shows the system from the front. FIG. 3 shows the system from the side. In production the backing fabric edges are finished by serging. The backing fabric ends are hemmed over the elastic that will form the slings for storing the bottles. Slings are separated by elastic being sewed to the backing fabric. Tucks secure the slings in the middle of the design with an open space for central eyelets. Two more eyelets are inserted in the end hems. These eyelets allow screws to install the system up in a hanging position. Alternately, string, ribbon etc could tie the system to wire shelving through the eyelets. Or glued hook and loop could be used where a solid receiving surface should not be marred. Jars are inserted into the slings for secure storage. This system uses previously wasted space underneath shelving and is tremor resistant for use in seismic areas, motor homes and boats. The preferred material is elastic and duck fabrics but could be any material capable of holding the containers securely.

I claim:

1. A spice and small item storage system comprising:

a flat backing panel of flexible material extending in a longitudinal direction;

an elastic sling, attached along a transverse direction of an underside of said flat backing panel at each end of said elastic sling;

said elastic sling further attached along said transverse direction of the underside of said flat backing panel at a plurality of predetermined equal spaced distances between said ends of said elastic sling to create a plurality of elasticized receptacles;

each elasticized receptacle containing a single container;

each of said elasticized receptacles having open transverse ends;

a rigid support member including a top surface and an underside surface;

said flat backing panel attached to said underside, wherein said flat backing panel is attached at the transverse midpoint of said ends of said flat backing panel and at the transverse and longitudinal midpoint of said flat backing panel.

2. The spice and small item storage system of claim 1 wherein the system is sized to hold pint, quart, two liter, and larger than two liter, containers.

3. The spice and small item storage system of claim 1 wherein said flexible material is fabric.

4. The spice and small item storage system of claim 1 wherein said attachment to said rigid support member is by grommets, screws, or ties.

* * * * *